US005684265A

United States Patent [19]

Strasser et al.

[11] Patent Number: 5,684,265

[45] Date of Patent: Nov. 4, 1997

[54] TURRET FOR A WHEEL-MOUNTED OR TRACKED VEHICLE

[75] Inventors: Friedrich-Wilhelm Strasser, Obermeitingen; Peter Ertl, Aichach; Hans-Jürgen Pollack, Augsburg, all of Germany

[73] Assignee: Kuka Wehrtechnik GmbH, Augsburg, Germany

[21] Appl. No.: 683,979

[22] Filed: Jul. 22, 1996

[30] Foreign Application Priority Data

Jul. 21, 1995 [DE] Germany ..... 195 26 664.1

[51] Int. Cl.[6] ..... F41A 9/00

[52] U.S. Cl. ..... 89/33.14; 89/33.16; 89/33.2; 89/36.13

[58] Field of Search ..... 89/33.14, 33.16, 89/33.2, 36.13, 45

[56] References Cited

U.S. PATENT DOCUMENTS

| | | | |
|---|---|---|---|
| 1,693,460 | 11/1928 | Paulus et al. . | |
| 2,445,853 | 7/1948 | Huey et al. . . | |
| 2,779,243 | 1/1957 | Molins et al. | 89/33 |
| 3,687,004 | 8/1972 | Faisandier . | |
| 4,601,230 | 7/1986 | LeBlanc | 89/33.14 |
| 4,840,108 | 6/1989 | Hurlemann et al. | 89/33.14 |
| 4,966,064 | 10/1990 | Kaustrater et al. | 89/46 |
| 5,076,138 | 12/1991 | Mannhart et al. | 89/33.16 |

FOREIGN PATENT DOCUMENTS

| | | |
|---|---|---|
| 2448313 | of 0000 | Germany . |
| 2552470 | of 0000 | Germany . |
| 2245777 | 4/1974 | Germany . |
| 3308676 | 9/1984 | Germany . |
| 3701713 | 8/1988 | Germany . |
| 4123338 | 1/1993 | Germany . |
| 4123771 | 1/1993 | Germany . |
| 4131280 | 3/1993 | Germany . |
| 4200903 | 7/1993 | Germany . |

*Primary Examiner*—J. Woodrow Eldred

*Attorney, Agent, or Firm*—Antonelli, Terry, Stout & Kraus, LLP.

[57] ABSTRACT

A turret for a preferably armored wheel-mounted or tracked vehicle is provided with a weapon and a magazine from which the weapon can be supplied with ammunition in belt form. The magazine is positioned in the turret laterally alongside the weapon and level therewith. The ammunition is received in the magazine in a substantially vertical orientation and on supply to the weapon is brought into alignment therewith. In order to be able to supply in a simple and reliable manner the ammunition to the weapon, the belted ammunition is wound up spirally in the magazine, the ammunition belt running freely from the magazine to the weapon without any guidance means and is twisted or turned. Preferably, on either side of the weapon, is located a corresponding magazine, which is downwardly inclined in the ammunition belt outlet direction.

17 Claims, 4 Drawing Sheets

TURRET FOR A WHEEL-MOUNTED OR TRACKED VEHICLE

Figure 1:
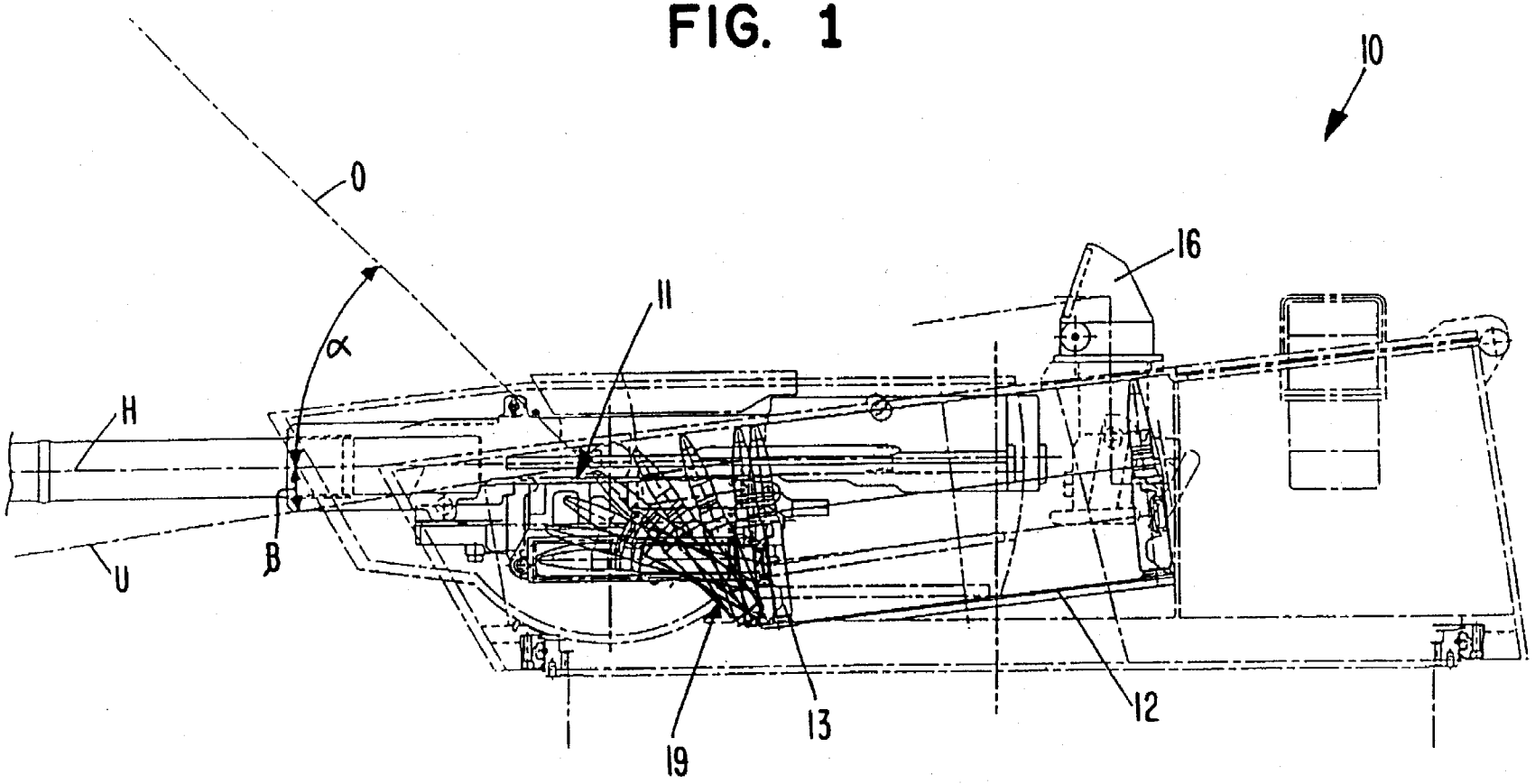

The invention relates to a turret for a preferably armoured wheel-mounted or tracked vehicle, having a weapon and a magazine from which the weapon can be supplied with ammunition in belt form.

Such a turret is normally used as a so-called one-man turret on armoured or unarmoured wheel-mounted or tracked vehicles, which are e.g. used for crisis reaction forces and as combat support vehicles. On the turret is mounted a main weapon with a calibre up to 30 mm.

In the known turret the ammunition for the weapon in belt form by means of a delivery or conveying channel from a magazine placed on a platform below the weapon. Admittedly the weapon can exert a certain tensile force, utilizing the gas pressure therein, on the ammunition belt containing ammunition or cartridges, but this is not generally sufficient to overcome the lift for the belt from the magazine to the weapon. In addition, friction forces, which also have to be overcome, occur in the delivery channel.

For this reason it is known to use mechanical delivery or conveying aids and boosters, which are intended to ensure a correct supply of the ammunition belt to the weapon.

However, as a result of the mechanical delivery aids and the booster, the construction becomes relatively complicated and therefore expensive. In addition, the constructional units takes up a large amount of space and are relatively heavy, so that for maintaining the overall weight of the turret it is necessary to reduce the pay load, particularly ammunition, which reduces the combat strength of the turret. It has also been found that as a result of the relatively long conveying distance from the magazine to the weapon, malfunctions can occur.

U.S. Pat. No. 4,840,108 discloses a turret, in which the magazine therein is positioned laterally alongside the weapon. The ammunition is received in the magazine, formed by an interchangeable container, in vertically oriented, standing form. Between the magazine and the weapon there is a flexible guide channel, in which the ammunition is supplied to the weapon and is oriented with the latter. However, the use of a flexible guide is trouble-prone and constructionally complicated.

The problem of the invention is to provide a turret of the indicated type, in which the ammunition can be supplied to the weapon in a simple and reliable manner.

In the case of a turret of the aforementioned type, this problem is solved in that the belted ammunition is would spirally into the magazine, the ammunition belt being supplied freely to the weapon from the magazine without any guidance mechanism.

As the magazine is located at substantially the same height as the weapon, no geodesic height has to be overcome on transporting the ammunition from the magazine to the weapon. This leads to the advantage that the tensile force in the weapon is sufficient for conveying the ammunition belt or supplying the ammunition without requiring delivery aids or boosters. This significantly simplifies construction and also saves much space and weight.

The vertical orientation of the ammunition in the magazine ensures a very good utilization of the existing transportation space and it has proved advantageous for the belted ammunition to be spirally coiled or wound up in the magazine, so that it can be drawn out of the magazine reliably and with only a limited extraction force. The further advantage is obtained that the magazine can be rapidly, easily and reliably loaded, in that e.g. a loaded belt is cranked in with per se known devices.

If a cartridge in the ammunition belt is drawn therewith out of the magazine, it has a substantially vertical orientation. In order to be able to pass automatically into the weapon, the cartridge must be aligned therewith, which in the case of a horizontal weapon also requires a horizontal orientation of the cartridge. The transfer from vertical orientation into horizontal orientation can be simply achieved by rotating or twisting the ammunition belt. It has been found that as a result of the low, necessary extraction force from the magazine and the inherent rigidity of the ammunition belt no guidance surfaces, channels or ducts are required, so that the ammunition belt is supplied freely from the magazine to the weapon.

Preferably the magazine comprises a rotary base plate with a central column, which simultaneously forms the rotation axis. The base plate can be surrounded by fixed side or boundary walls. The rotary base plate facilitates the drawing off of the wound up ammunition belt and in a preferred development there is a braking mechanism for the base plate, whose braking force is adjustable and prevents an unintentional, excessive extraction of the ammunition belt.

According to a further development of the invention, on either side of the weapon is provided a magazine, so that there is a large ammunition supply and an ammunition belt can be supplied both from the right and left to the magazine. This is particularly advantageous if the weapon is equipped with a per se known twin-belt conveyor. The two magazines are preferably of the same size and have the same construction, but, if necessary, can also be given different sizes and can optionally receive ammunition of different types.

According to a preferred development of the invention, the magazine is inclined downwards in the ammunition belt outlet direction. The magazine outlet preferably faces the weapon, so that the inclination of the magazine gives the ammunition belt assistance during conveying as a result of a gravity component.

It has proved advantageous to provide in the vicinity of the magazine outlet a guide roll or pulley, so as to prevent jamming of the ammunition belt on extraction from the magazine.

Preferably the ammunition belt is fixed in the weapon and is only fed through the latter. The ammunition preferably runs over the shortest possible path from the magazine to the weapon and on said path the ammunition belt automatically assumes the optimum, twisted position.

Once the cartridges have been released or removed from the ammunition belt in the weapon, the belt passes out of the latter. As the ammunition belt is normally to be reused, it must be stored up to the next reloading operation. According to an advantageous development of the invention the ammunition belt, which preferably comprises several mutually engaging belt members or links, is broken down into its said members or links with the aid of a separating device following the removal of the ammunition and the discharge from the weapon. Preferably the separating device is followed by a conveying mechanism by means of which the separated belt links are supplied to a collecting container. The conveying mechanism can e.g. be a chute. The collecting container should be located in the turret.

It has proved advantageous for the separating device to be directly installed on the weapon or the twin-belt supply conveyor of the weapon. The separating device can be constituted by a guide surface by means of which the in each case outer, i.e. to be individualized belt link can be pivoted relative to the following belt link and therefore disengaged. It has proved particularly appropriate to use a concave, upwardly curved guide surface.

After firing the projectile or shell the empty cases of the ammunition are normally ejected upwards out of the weapon and turret. If the weapon has its maximum, upwardly directed inclination, there is a risk of the ejected cases, instead of flying upwards, passing rearwards in inclined manner so as to strike and damage superstructures of the turret and in particular the target optics. Thus, according to a further development of the invention, an ejection channel or duct is provided, which in the case of an upwardly inclined weapon forms a guide for the cases to be ejected so as to ensure a desired ejection direction and in particular a vertically upward direction. If the weapon is in its normal, horizontal position, the ejection channel does not function, because the cases are ejected vertically upwards out of the weapon and therefore also vertically with respect to the turret. In the case of an upwardly inclined weapon the ejection channel ensures that the cases ejected vertically with respect to the weapon and inclined with respect to the turret are so deflected that they fly upwards relative to the turret.

In order to keep clear the view for the target optics, in no weapon position must the ejection channel project over the top of the turret. Therefore, in an advantageous development of the invention, the ejection channel is formed from several segments, which are interconnected in articulated, fan-like manner and are adjustable relative to one another when the weapon is directed upwards. The weapon-side segment is fixed to the weapon carrier, whilst the segment located at the other end of the ejection channel is in engagement with the turret casing. If the weapon is directed upwards, the rear end of the weapon with the ejector for the cases drops relative to the turret casing. This height difference is then bridged by the segments adjustable in fan-like manner to one another, so that the base always passes out upwards in the desired manner.

If, according to the invention, the magazine and therefore the ammunition is located in the turret, there is a risk of the ammunition exploding if the turret is hit by a shell. To prevent damage to the vehicle carrying the turret, according to an advantageous development the turret casing has a pressure-stable base plate defining the turret with respect to the vehicle interior below it. Preferably the operator area in the turret, where the weapon operator is positioned, is shielded from the magazine by a pressure-stable bulkhead. According to a further development of the invention, on the top of the turret above the magazine is provided at least one easy to blow-off and hinge-up plate. In the base of an ammunition explosion within the turret, it ensures a directed depressurization in the outward and/or upward direction.

Further details and features of the invention can be gathered from the following description of an embodiment with reference to the attached drawings, wherein show:

FIG. 1 A vertical longitudinal section through a turret.

Figure 2:
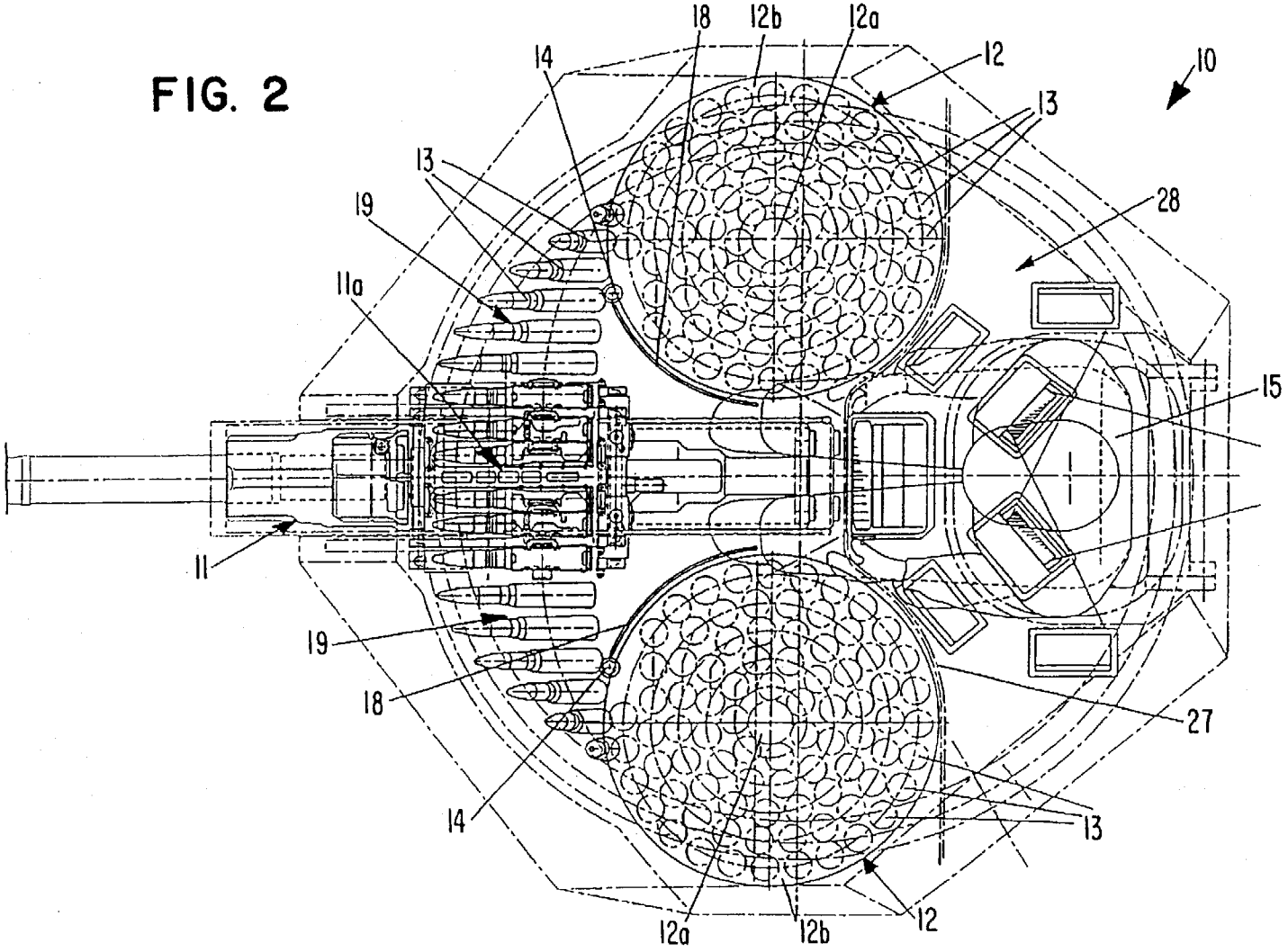

FIG. 2 A horizontal section through the turret of FIG. 1.

Figure 3:
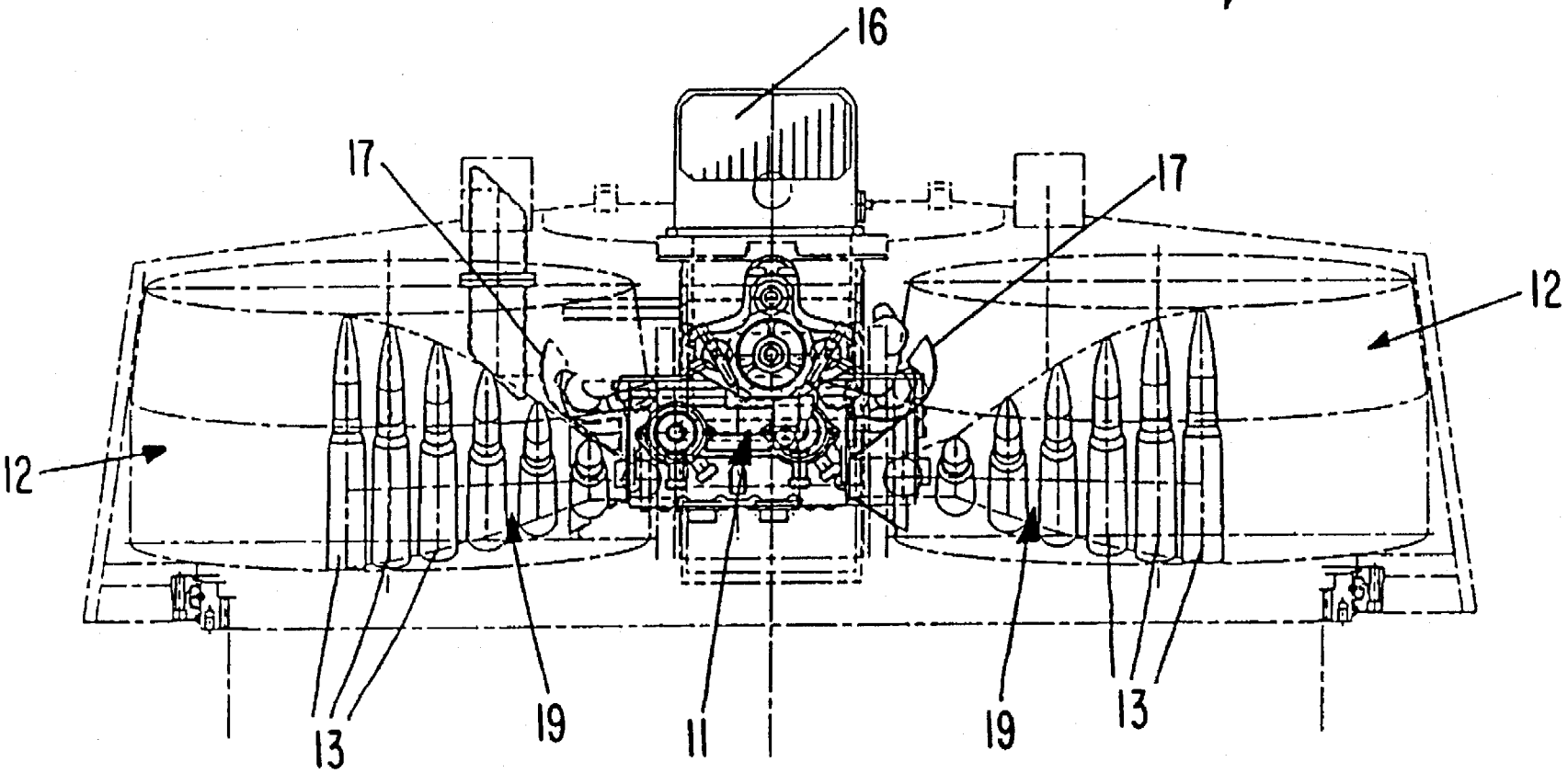

FIG. 3 A vertical section through the turret of FIG. 1.

Figure 4:
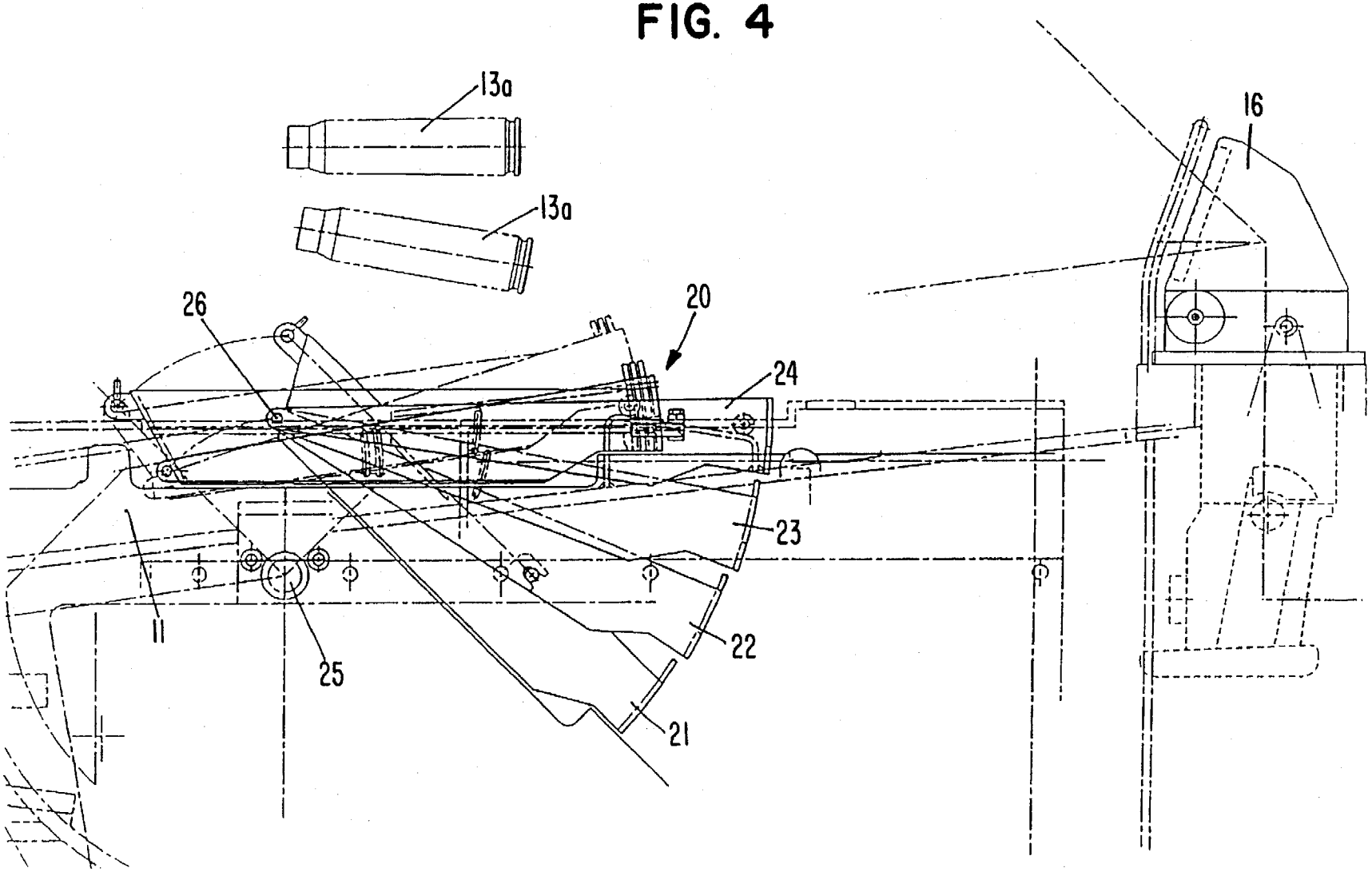

FIG. 4 The ejection channel for ammunition cases.

According to FIG. 1 a turret 10, which is normally rotatably mounted on a not shown vehicle, has a weapon 11 which, apart from its normal, horizontal position H, can be moved into a position U inclined downwards by an angle β indicated solely by the corresponding axis and into a position O inclined upwards about an angle α. Behind the weapon is located a target optics 16 enabling an operator 15 sitting behind the weapon in an operator space 28 according to FIG. 2 to orient the weapon 11 in the desired manner.

On either side of the weapon 11 is provided a magazine 12, in which is spirally wound an ammunition belt 19 with loaded cartridges 13. As can in particular be gathered from FIG. 1, the cartridges 13 are arranged in a substantially vertically standing manner within the magazine 12, which is inclined slightly downwards towards the weapon 11. Close to the outlet of the magazine 12, which is bounded by inside dividing walls 18, is provided a guide roll or pulley 14, which prevents a jamming of the ammunition belt 19 during delivery. The area of the turret housing the magazines 12 is separated from the operator space 28 by a pressure-resistant bulkhead 27. The magazine 12 has a base plate **12*b* rotatable about a central column 12*a* and on which is mounted the ammunition belt in the wound up state. The base plate 12*b* is subject to the action of a not shown, adjustable braking mechanism. The ammunition belt 19 is placed in a twin-belt conveyor 11*a* of the weapon 11, the ammunition entering the weapon in the orientation of the latter. Thus, after leaving the magazine 12 the ammunition belt 19 is rotated or twisted by substantially 90°, as shown in the drawings and runs freely from the magazine 12 to the weapon 11** without any guidance means.

When the cartridges 13 have been removed from the ammunition belt 19 in the weapon and the empty ammunition belt passes out of said weapon 11, the outer belt member or link of the ammunition belt 19 travels on a concave, upwardly curved guide surface 17 (cf. FIG. 3), so that it is pivoted relative to the following belt member or link. Thus, the two interengaged belt links are disengaged, so that the outer, now separated belt link can be supplied by means of the guide surface 17, constructed as a chute, to a not shown collecting container within the turret 10.

As shown in FIG. 4, the empty cases **13*a* are ejected substantially vertically upwards out of the weapon 11. In the case of a horizontal orientation of the weapon this causes no problem, because the target optics 16 behind the weapon cannot be struck by the ejected cases 13*a*. However, if the weapon is in the position O inclined upwards by the angle α and shown in FIG. 1, the cases 13*a* ejected vertically to the weapon are now ejected in rearwardly inclined manner relative to the turret. To prevent the cases 13*a* from striking the target optics 16, a fan-like ejection channel 20 is provided, as shown in FIG. 4. The ejection channel 15 comprises four segments 21, 22, 23, 24, which can be moved into one another and are interconnected in articulated, fan-like manner. The lower segment 21 in FIG. 4 is fixed to the top of the weapon. The segment 24 at the other end of the ejection channel 20 is in engagement with the turret casing. This ensures that the opening of the ejection channel 20 or the last segment 24** always defines an ejection direction directed vertically upwards with respect to the turret.

If the weapon is pivoted upwards about the pivot bearing 25, the segment 21 fixed to the weapon is pivoted downwards about the common fulcrum 26. As the segment 24 at the other end is in engagement with the turret, the ejection channel 20 is brought into its extended position shown in FIG. 4. The cases **13*a* ejected in rearwardly inclined manner from the weapon with respect to the turret in this state are so deflected by the ejection channel 20** that they pass out in a substantially vertically upwardly directed manner.

As is shown in FIG. 4, the view for the target optics 16 is not impeded by the ejection channel 20 in any position of the weapon 11, because the segments do not project over the upper edge of the turret.

We claim:

1. Turret for an armoured vehicle, with a weapon (11) and a magazine (12) from which the weapon is supplied with ammunition in belt form, the magazine (12) in the turret (10) being positioned laterally alongside the weapon (11) and substantially at the same height and the ammunition (13) is received in the magazine (12) in a substantially vertical orientation and during supply to the weapon (11) is brought into alignment therewith, characterized in that the belted ammunition (13) is spirally wound in the magazine (12), the ammunition belt (19) passing freely to the weapon (11) from the magazine (12) without any guidance means.

2. Turret according to claim 1, characterized in that a magazine (12) is located on both sides of the weapon (11).

3. Turret according to claim 1, characterized in that the magazine (12) has a rotary base plate (12*b*) with a central column (12*a*), a braking mechanism being associated with the base plate (12*b*).

4. Turret according to claim 1, characterized in that during the supply of the weapon (11), the ammunition belt (19) is rotated from a substantially vertical orientation into a substantially horizontal orientation.

5. Turret according to claim 1, characterized in that the magazine (12) is downwardly inclined in the outlet direction of the ammunition belt (19).

6. Turret according to claim 1, characterized in that the ammunition belt (19) is fixed in the weapon (11) and is delivered by the latter.

7. Turret according to claim 1, characterized in that a guide pulley (14) is positioned close to the outlet of the magazine (12).

8. Turret according to claim 1, in which the ammunition belt comprises several interengaging belt links, characterized by a separating device (17) by means of which the belt links is separated following the removal of the ammunition (13) and discharge from the weapon (11).

9. Turret according to claim 8, characterized in that the separating device (17) is fitted to the weapon (11).

10. Turret according to claim 8, characterized in that the separating device has a guide surface (17) by means of which the in each case outer belt link is pivoted relative to the following belt link and consequently disengaged.

11. Turret according to claim 10, characterized in that the guide surface (17) is curved in upwardly concave manner.

12. Turret according to claim 8, characterized in that the separating device (17) is followed by a conveying mechanism by means of which the separated belt links is supplied to a collecting container.

13. Turret according to claim 1, in which the empty ammunition cases are ejected upwards out of the weapon, characterized by an ejection channel (20), which in the case of an upwardly inclined weapon (11) forms a guide for the cases (13*a*) to be ejected so as to ensure a desired ejection direction.

14. Turret according to claim 13, characterized in that the ejection channel (20) is formed by several segments (21, 22, 23, 24), which are interconnected in an articulated, fan-like manner and are adjustable relative to one another with an upwardly directed inclination of the weapon.

15. Turret according to claim 1, characterized in that the turret casing has a pressure-stable base plate defining the turret with respect to the vehicle interior located below it.

16. Turret according to claim 15, characterized in that the magazines are shielded by means of a pressure-stable bulkhead (27) from an operator area (28) of the turret and the vehicle interior.

17. Turret according to claim 15, characterized in that at least one easily depositable and blow-off plate is provided above the magazines (12) on the top of the turret.

* * * * *